US006211770B1

(12) United States Patent
Coyle

(10) Patent No.: US 6,211,770 B1
(45) Date of Patent: Apr. 3, 2001

(54) METAL OXIDE VARISTOR MODULE

(75) Inventor: Michael J. Coyle, Deer Park, NY (US)

(73) Assignee: MCG Electronics, Inc., Deer Park, NY (US)

( * ) Notice: Subject to any disclaimer, the term of this patent is extended or adjusted under 35 U.S.C. 154(b) by 0 days.

(21) Appl. No.: 09/300,198

(22) Filed: Apr. 27, 1999

(51) Int. Cl.[7] ..... H01C 7/10

(52) U.S. Cl. ..... 338/21; 338/101; 338/110; 361/104; 361/124; 361/125

(58) Field of Search ..... 361/104, 117, 361/124, 125, 126; 338/20, 21, 101, 110

(56) References Cited

U.S. PATENT DOCUMENTS 3,626,348 * 12/1971 Alten ..... 338/20
4,096,464 * 6/1978 Dennis et al. ..... 361/104
4,249,224 * 2/1981 Baumbach ..... 361/124
4,907,119 * 3/1990 Allina ..... 361/104
5,198,791 * 3/1993 Shibayama et al. ..... 361/124
5,276,422 * 1/1994 Ikeda et al. ..... 361/124
5,311,164 * 5/1994 Ikeda et al. ..... 361/124
5,436,787 * 7/1995 Ballinger ..... 361/126
5,721,664 * 2/1998 Uken et al. ..... 361/125
5,901,027 * 5/1999 Ziegler et al. ..... 361/124
5,936,824 * 8/1999 Carpenter, Jr. ..... 361/126

* cited by examiner

*Primary Examiner*—Karl D. Easthom
(74) *Attorney, Agent, or Firm*—Bauer & Schaffer, LLP

(57) ABSTRACT

A metal oxide varistor module, and variations thereof for use in surge protectors and the like combining internally a thermally activated disconnect means and an excessive current disconnect means, such that when the module is subject to excessive overvoltage or overcurrent conditions, the connection is interrupted from the phase to neutral, phase to ground and any other combination of voltage or current before the metal oxide varistor device is physically damaged, ruptured or cracked.

36 Claims, 5 Drawing Sheets

METAL OXIDE VARISTOR MODULE

BACKGROUND OF THE INVENTION

The present invention relates to surge arresters and/or transient voltage surge suppressor devices, and in particular, to surge arresters or suppressors that employ Metal Oxide Varistors, Silicon Avalanche Diodes, Selenium Rectifiers, Silicon Controlled Rectifiers, Triacs and other semiconductor devices, singly or in combination. The term MOV will describe the application of Metal Oxide Varistors specifically but will also be employed as a generally representative term for the equivalent application of the above mentioned technologies.

The objective of a surge arrester is to provide a low impedance path for a high voltage transient at a defined voltage level. Some surge arresters, especially those for power conditioning circuits, employ a multiplicity of Metal Oxide Varistor modules to accomplish this task.

Metal Oxide Varistors are surge protection devices that are connected across power circuits and provide protection for equipment connected to such power circuits from temporary voltage peaks and transients.

Metal oxide Varistors have a standard operating mode for normal conditions where the voltage across the circuit is stable and a clamping mode for transient and overvoltage conditions. During clamping mode the MOV acts to reduce the maximum voltage across the circuit to a predefined level.

There are several problems with MOV based surge arresters. One problem is that MOV modules when subjected to an excessive voltage will overheat rendering the surge arrester inoperable. For example, when power sources are subject to long duration surge conditions, these lines may produce large voltages and associated currents large. The MOV when subject to these extreme conditions will overheat, rupture, and/or produce noxious gases and/or particles. Further, the ruptured MOV will permit a plasma arc to occur between the sections of the MOV thereby endangering the electronic device to which the surge arrester is attached.

Furthermore, over time and through use, MOV modules deteriorate thereby lowering the maximum voltage the modules can adequately handle. Specifically, when the clamping threshold of the MOV module deteriorates to the point where it descends into the peak of the power line sine-wave voltage the module will overheat and fail in the manner described above. This effect may also occur if the clamp threshold descends to at or slightly below the DC level.

Additionally, MOV's can fail in an essentially short circuit mode when subjected to excessive transient peak currents. For example, conventional 40 mm diameter MOV's are rated to handle 40 kA, 8/20 microsecond waveforms for 1 event. At peak currents in excess of 40 kA the MOV will fail as a "short circuit". If the MOV is not properly fused, excessively current flow through the MOV will cause it to rupture and permit a plasma arc to occur between the sections of the MOV thereby endangering the electronic device to which the surge arrester is attached.

Attempts have been made to solve the problems described above by individually fusing each of the MOV modules within a given surge arrester. For example, U.S. Pat. No. 5,808,850 to Carpenter discloses a three phase MOV surge arrester that employs a plurality of MOV modules, each of the MOV modules having an associated external fuse. Improper fuse coordination with the MOV characteristics or improper substitution in the field personnel can permit a plasma arc to occur between the sections of the MOV thereby endangering the electronic device to which the surge arrester is attached. In addition, fuses of this type are rated on a current, i.e. ampere basis and as a consequence do not operate or otherwise measure the thermal state of the MOV module. Thus, over time, and as the MOV module begins to deteriorate, an external fuse is inadequate to protect the MOV from failure as the MOV will overheat long before the fuse is triggered, if ever.

It is therefore, an object of the present invention to provide an improved MOV module for use with surge arresters that overcomes the disadvantages and shortcoming found in the prior art.

It is further object of the present invention to provide an improved MOV module that will not greatly overheat, rupture or otherwise fail when subject to extreme voltage or current conditions.

It is further object of the present invention to provide an improved MOV module that will permit the manufacturer to integrate, within the MOV housing, both thermal and overcurrent disconnect capabilities which will prevent overheating, rupture or otherwise catastrophic failure when subject to extreme voltage or current conditions.

Other objects and features of the present invention will be apparent from the following disclosure.

SUMMARY OF THE INVENTION

According to the present invention an improved MOV module is provided for use in surge protectors or the like, that will provide an excessive current disconnect capability and a thermal disconnect capability, such that when the MOV module is subject to excessive current or voltage conditions, the connection is interrupted from the phase to neutral, phase to ground and any other combination of voltage before the MOV device is physically damaged, ruptured or cracked. In this manner, the formation of destructive plasma is avoided. These disconnect capabilities can function together in an integrated fashion or operate independently to provide a variety of device disconnect options.

In general, the present invention provides a MOV module including, a pair of planar contact plates, a layer of MOV material, and an excessive current and/or thermally operated disconnect switch. The disconnect switch being operable from a first standard connected position to a second disconnected position. In this manner, when the MOV material reaches a predetermined temperature, or the MOV material is exposed to excessive current, or both, the switch is triggered to disconnect thereby breaking the circuit and protecting the MOV module from any further connection to the power source and any physical damage that may result therefrom. In this way, the MOV module is disconnected before physical damage of the same.

DETAILED DESCRIPTION OF THE INVENTION

Figure 1:
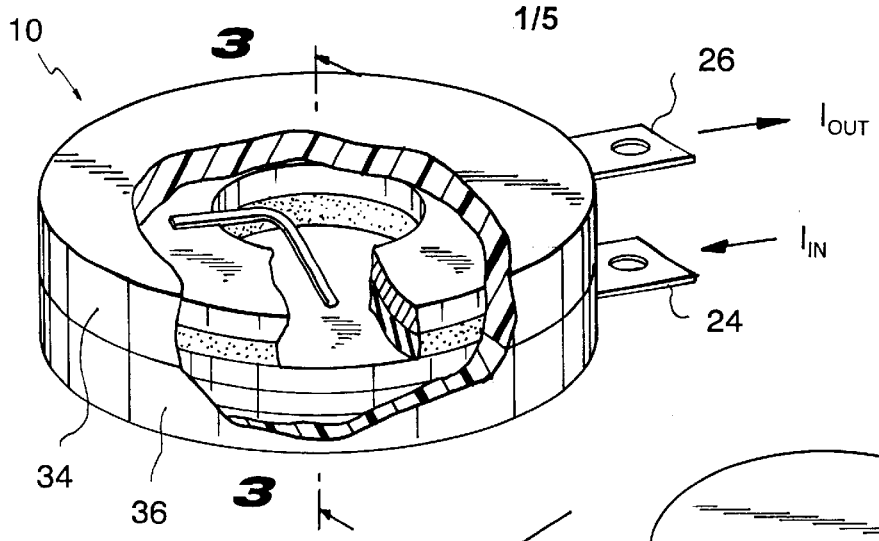
FIG. 1 is a perspective view of the MOV module according to the present invention.
Figure 2:
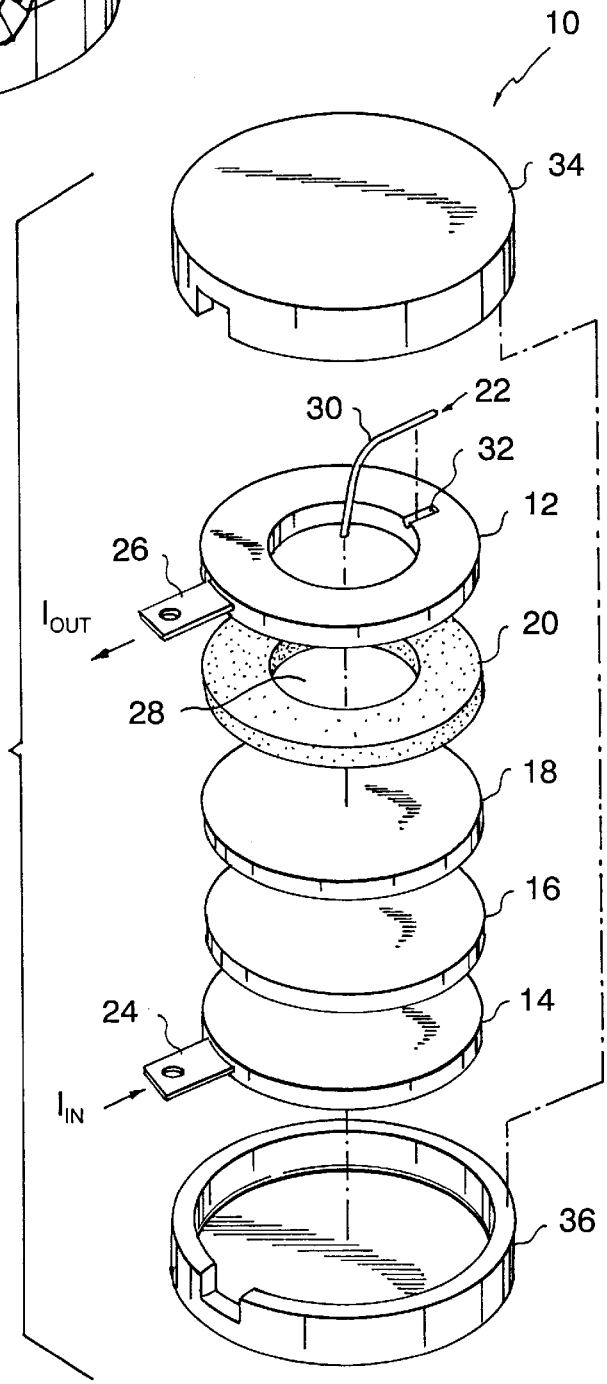
FIG. 2 is an exploded perspective view of the MOV module shown in FIG. 1.

As seen in the FIGS. 1 and 2, the Metal Oxide Varistor module according to the present invention, generally depicted by the numeral 10, has a laminar construction including first and second parallel conductive contact plates, 12 and 14 respectively, a layer of metal oxide varistor material 16, an intermediate layer of conductive material 18, a layer of insulating material 20 and a activated trigger assembly 22.

As seen in FIG. 2, the MOV module according to the present invention has a pair of parallel planar contact plates 12 and 14. The lower contact plate 14 comprises a generally disk-like metallic body having a tab 24 extending from the peripheral edge thereof. The tab 24 is configured to receive an electrical lead for the introduction of current into the MOV module. The current as introduced into the module is depicted as $I_{in}$ FIGS. 1 and 2. The other, or upper contact plate 12, has a washer-like body as shown, having a hole passing through the center of its body. Extending from the peripheral edge of upper contact plate 12 is a tab 26 for connection to an electrical lead for the current leaving the MOV module. The current leaving the MOV module is depicted as $I_{out}$ in FIGS. 1 and 2.

The contact plates 12 and 14 are preferably constructed from Aluminum, as Aluminum has favorable heat dissipation and conductivity characteristics. Nonetheless, other suitable materials may also be used.

Superimposed over the upper surface of contact plate 14 is a layer of MOV material 16. As shown, the layer of MOV material 16 extends across and over the upper surface of contact plate 14 so that it covers the entire upper surface of the contact plate 14. The layer of MOV material 16 has planar and parallel upper and lower faces that permits effective transmission into and through the MOV layer. Further, the layer of MOV material is shaped so that it overlies the contact plate 14 such that its peripheral edge is coextensive with the peripheral edge of the contact plate. It is preferable that Aluminum Oxide be used in the construction of the MOV layer, however other suitable materials may be used.

Mounted to the upper surface of the MOV material 16 is an intermediate layer of conductive material 18 preferably constructed from the same material as the upper and lower contact plates 12 and 14, e.g. aluminum. As shown, the intermediate layer of conductive material has a disk like body that planar in construction and is shaped so that it overlies and extends across the upper surface of the MOV layer 16. The intermediate layer of conductive material 18 is mounted such that its lower surface abuts the upper surface of the MOV material 16. Further, as shown, the peripheral edge of the conductive material 18 is coextensive with the peripheral edge of the MOV layer 16. The construction as defined above permits the efficient transmission of energy through and into the intermediate conductive layer 18.

Mounted to the upper surface of the intermediate conductive layer 18 is a layer of insulating material 20. As shown, the layer of insulating material 20 has a washer-like body having planar upper and lower surfaces with a central orifice 28 passing therethrough. The central orifice or gap 28, as will be described in greater detail hereinafter, permits the activated trigger assembly 22 access to intermediate conductive layer 18. The insulating layer 20 is shaped so that its peripheral edge is substantially coextensive with the peripheral edge of the intermediate conductive layer 18.

The insulating material 20 is mounted to contact plate 18 so that its lower surface abuts the upper surface of contact plate 18 as shown.

Mounted to the upper surface of the insulating layer 20 is the contact plate 12. Finally, mounted to the upper or exterior surface of plate 12 is the activated trigger assembly 22.

In one embodiment, the trigger assembly 22 comprises a spring element 30 connected at a first end to the upper surface of the plate 12 and at a second end to the upper surface of intermediate contact plate 18. The upper surface of the contact plate 12 may be provided with a cut out or seat 32 for receiving the spring element as shown in FIG. 2. The trigger assembly 22 may, alternately be an integral part of plate 12 to facilitate manufacturing and minimize production costs.

Figure 3:
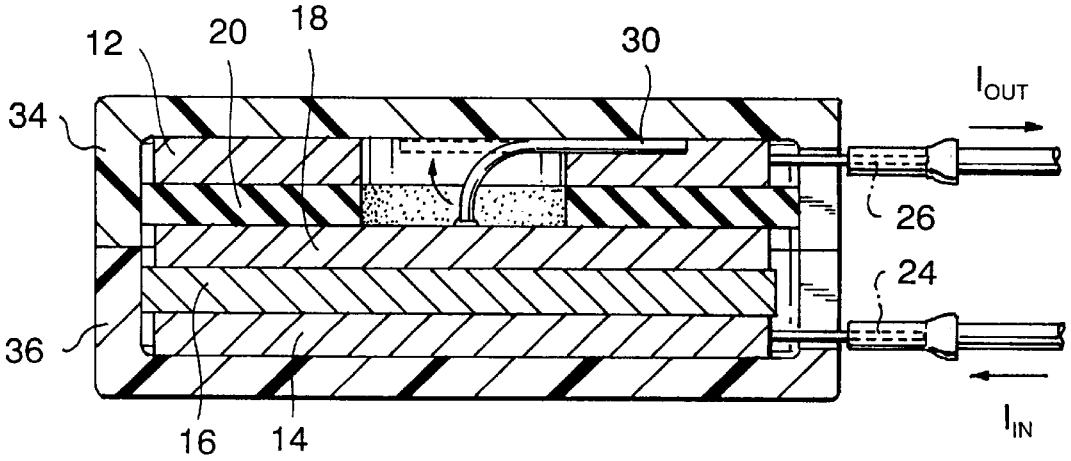
FIG. 3 is a sectional view of the MOV module shown in FIG. 1 taken along line 3—3.

As best seen in FIG. 3, the second end of the spring element 30 is secured to the upper surface of the intermediate conductive layer 18 using a low temperature solder, or the like. During overvoltage conditions, the temperature of conductive layer 18 will rise as a result of the heat generated in the MOV material 16. When the conductive layer 18 reaches a selected temperature below the melting or failure temperature of the MOV material 16 the solder melts, thereby releasing the second end of the spring element. The spring element 30 is biased so that when the solder melts the spring element travels from a first position in electrical connection with and abutting the intermediate contact plate 18 to a second position remote from and electrically disconnected from the plate 18. The second position is depicted by the dotted lines 35 as seen in FIG. 3. It is critical that the second position be sufficiently spaced from the intermediate conductive layer 18 to prevent arc over from the conductive layer 18 to the spring element 30 when the spring element is in the second position.

During overcurrent situations,it should be noted that the spring element 30 individually, or as an integral part of contact plate 12, can be designed with a specific cross-sectional area permitting the finger to melt open and thus operate directly as a fuse for excessive current passing through the MOV material. The overcurrent disconnect would operate at a current level less than the failure point of the MOV material.

Although only a single spring element is shown in FIG. 3, it is appreciated that multiple spring elements could be employed by securing them to the contact plate 12 and the intermediate conductive layer in the fashion described above. Multiple spring elements would provide a larger range of current fusing capability while retaining the independent thermal character of the invention.

The construction of the MOV module is completed by chamber covers 34 and 36 that are configured to conceal and protect the interior components of the MOV module. The chamber covers are constructed from a suitable insulator and are provided with cut out sections to allow access to terminal tabs 24 and 26. The chamber may be fitted to be gas tight so that a gas or other means to assist in extinguishing an arc may be used. In lieu of chamber covers, an epoxy encapsulation procedure may be used to seal the MOV module if desired.

Figure 4:
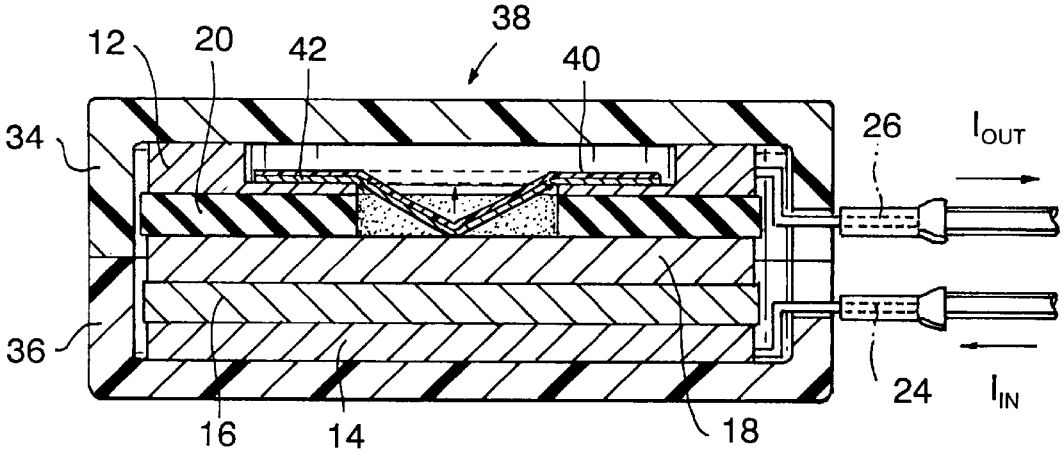
FIG. 4 is a sectional view of a second embodiment of the MOV module according to the present invention.

A second embodiment of the MOV module according to the present invention, generally depicted by the numeral 38, is shown in FIG. 4. In the second embodiment, the trigger assembly comprises a plastic sheet 40 or the like having a thin layer of metal 42 on the undersurface thereof. The central portion of the plastic sheet is connected along its lower surface to the intermediate conductive layer 18 using a low temperature solder. In this manner, when the MOV material 16 heats to a predetermined temperature the low temperature solder will melt releasing the plastic sheet. The plastic sheet is biased so that when it releases it travels from a position where its lower surface is adjacent to and abutting the upper surface of the conductive layer 18 to a second position remote from the conductive layer as shown by the dotted lines in FIG. 4. In all other respects the MOV module according the alternate embodiment is identical to the MOV module described above.

It should be noted that the MOV module 38 embodies a dual protection method, i.e., it will respond independently to a thermally activated disconnect condition as well as performing an excessive current disconnect function. The current disconnect capability is a function of foil geometry and thickness and would be designed to be less than the current damage level of the MOV material.

Figure 5:
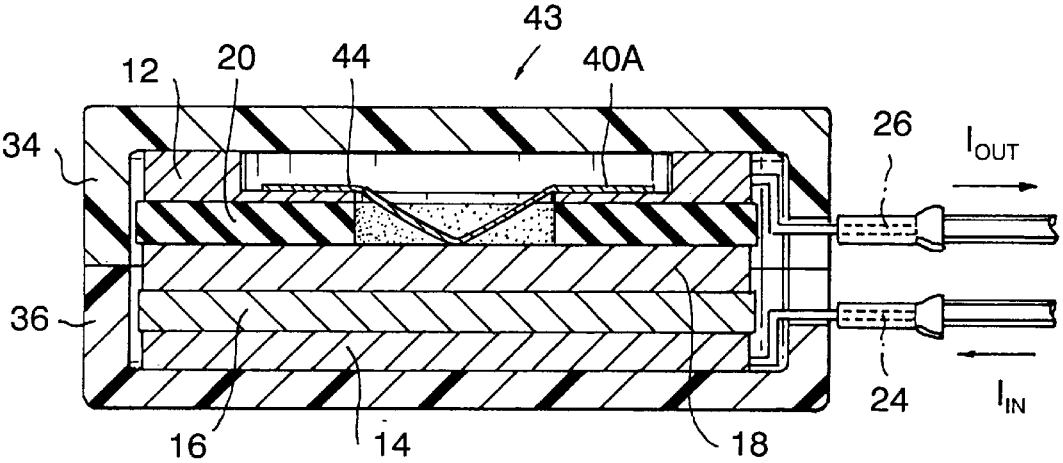
FIG. 5 is a sectional view of a third embodiment of the MOV module according to the present invention.

A third embodiment of the MOV module according to the present invention, generally depicted by the numeral 43, is shown in FIG. 5. In this embodiment the trigger assembly comprises a metallic foil sheet 44 that is electrically connected at its edges to the contact plate 12. In this embodiment the contact plate 12 may be provided with two seats, or a cut out perimeter section, for receiving the edges of the metallic foil sheet as seen in FIG. 5. Alternately, sheet 44 may be combined or integrated with plate 12 to faciliate manufacturing and reduce production costs. The central portion of the metallic foil sheet 44 is electrically connected along its lower surface to the intermediate conductive layer 18 either by using a solder, by welding or applying sufficient pressure to the same. In this way, the metallic foil 44 is held in abutment with the upper surface of the intermediate conductive layer 18, under normal operating condition.

During overvoltage conditions, the MOV material 16 heats, to a predetermined temperature, melting affixing low temperature solder and disconnecting the MOV layer 16 from the power source. The low temperature solder will melt at a temperature that is less than the MOV material damage level.

During overcurrent conditions, the metallic foil sheet 44 will melt when a predetermined current passes through the MOV material 16 and the foil sheet 44 thus disconnecting the MOV layer 16 from the power source. The foil will melt at a current level that is less than the rated MOV material damage level.

It should be noted that the MOV module 43 embodies a dual protection method, i.e., it will respond independently to a thermally activated disconnect situation as well as disconnecting in an excessive current situation.

Figure 6A:
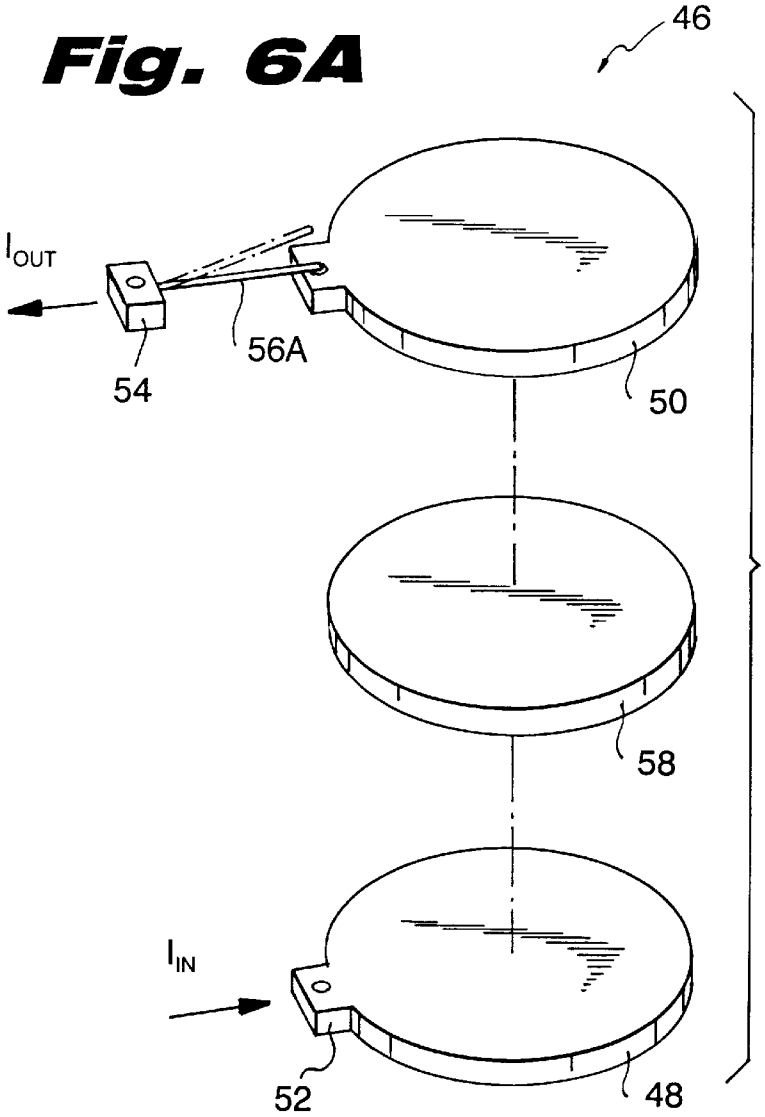
FIG. 6A is an exploded view of a one version of the fourth embodiment of the MOV module according to the present invention.
Figure 6:
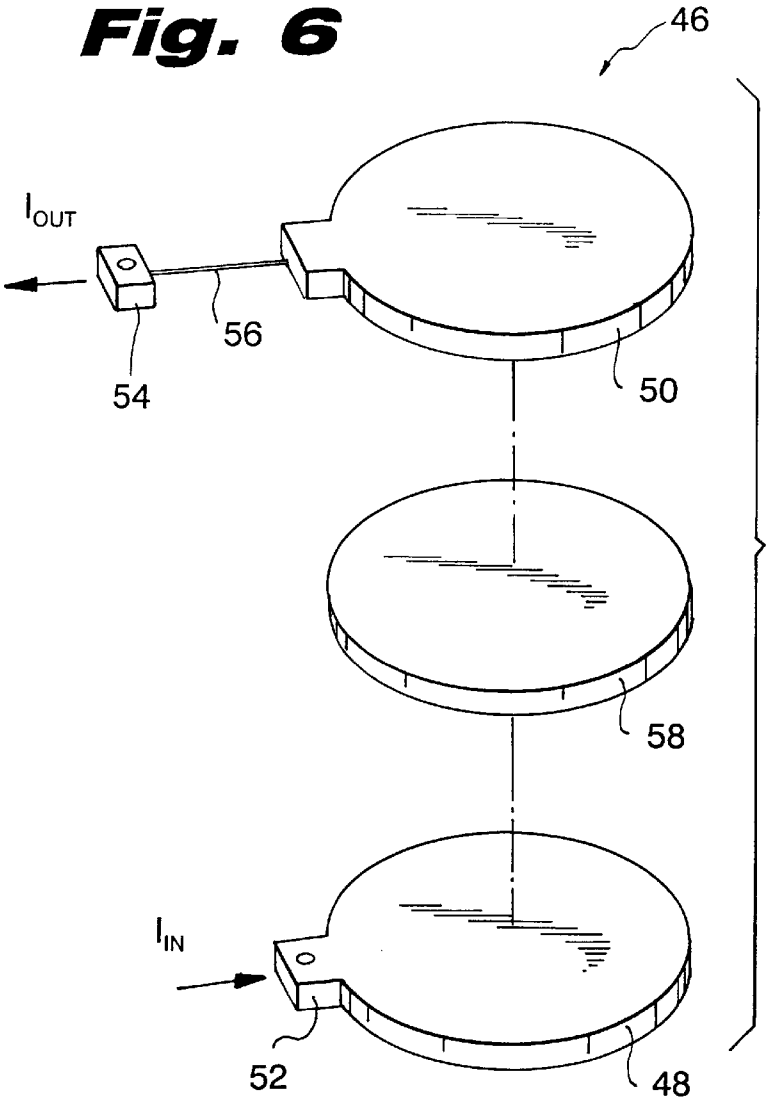
FIG. 6 is a sectional view of a fourth embodiment of the MOV module according to the present invention.

A fourth embodiment of the MOV module according to the present invention, generally depicted by the numeral 46 is shown in FIG. 6. In this embodiment, the MOV module includes a first or lower metallic contact plate 48 and a second or upper metallic contact plate 50. Each of the contact plates have planar parallel upper and lower faces. Further, the peripheral edge of each of the contact plates are substantially coextensive with one another.

The lower contact plate 48 has a tab 52 extending from the peripheral edge thereof configured to receive an electrical lead for introduction of current Iin into the MOV module. The other or upper contact plate 50 has a connection tab 54 that is displaced, i.e. spaced, from the body of the contact plate 50. The connection tab 54 is electrically connected to the body of the contact plate 50 by a conductive material 56 that functions as a disconnect element.

Interposed between the contact plates 48 and 50 is a layer of MOV material 58. As shown, the layer of MOV material 58 is disk-like having upper and lower planar faces. The peripheral edge of the MOV material is substantially coextensive with the peripheral edges of contact plates 48 and 50.

Figure 6B:
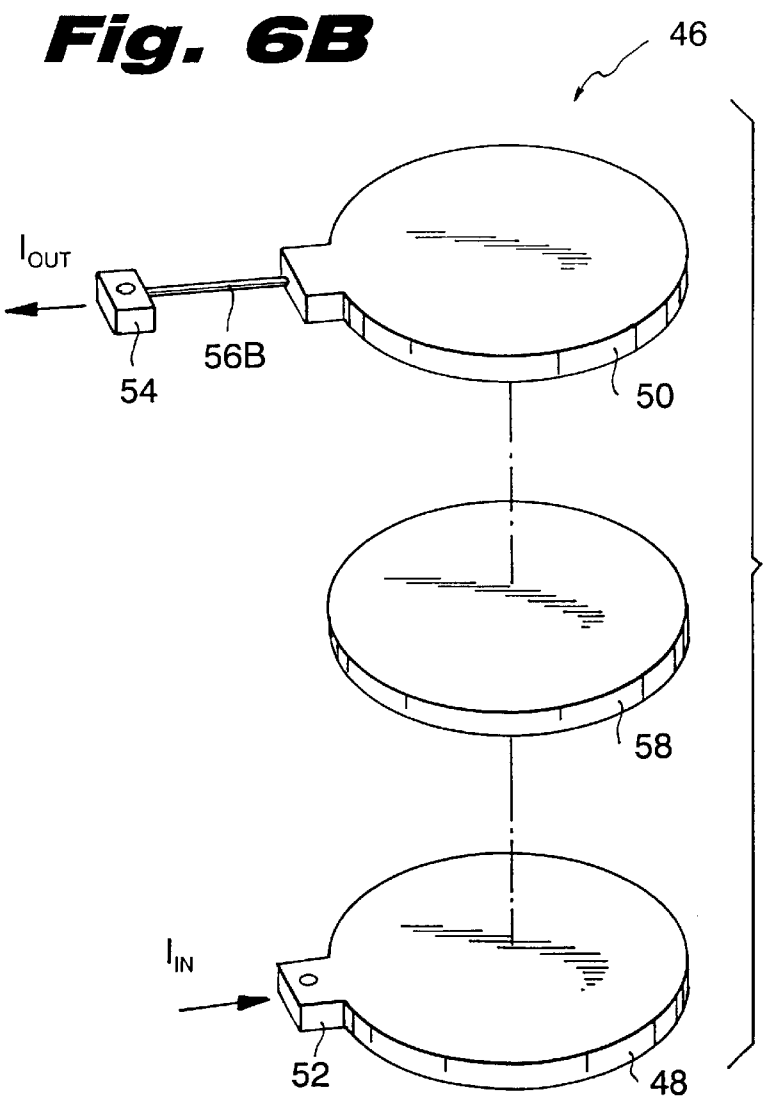
FIG. 6B is an exploded view of a second version of the fourth embodiment of the MOV module according to the present invention.

Disconnect element 56 can be constructed in at least two configurations, as shown in FIGS. 6A and 6B.

In configuration 56A, as shown in FIG. 6A, the disconnect capability is achieved employing a metal spring finger 56A that at the first end is connected to tab 54 and at the second end is connected to contact plate 50 using a low melting point solder.

During excessive voltage conditions, the MOV material 58 will heat the upper contact plate 50 thereby raising the temperature of the same. The contact plate 50 will heat the low temperature solder affixing disconnect element 56A to the contact plate 50 as shown in FIG. 6A. Once this selected temperature is reached the disconnect element 56A will separate i.e., spring away, thereby disconnecting the MOV module 46 from any further electrical power source. It is critical that the selected melting temperature of the low temperature solder be less than the physical disintegration or rupturing temperature of the MOV material 58.

In the presence of excessive currents, the disconnect element 56A can be constructed with a specific cross-sectional area to interrupt a selective current. It is critical that the selected current disconnect level be less than the current damage level of the MOV material 58.

In the disconnect element 56A, the dual interrupt capabilities disclosed above can be dependent or independent of each other thus providing a thermal interrupt capability and an independent excessive current interrupt capability while preventing the MOV material from overheating and rupturing.

During excessive voltage conditions, as shown in FIG. 6B, the MOV material 58 will heat the upper contact plate 50 thereby raising the temperature of the same. The contact plate 50 will heat the metallic composite disconnect element 56B. Once a selected temperature is reached the disconnect element 56B will melt thereby disconnecting the MOV module 46 from the power source. It is critical that the selected melting temperature of disconnect element 56B be less than the physical disintegration or rupturing temperature of the MOV material 58.

In the presence of excessive currents, the disconnect element 56B can be constructed with a specific cross-sectional area to interrupt a selective current. It is critical that the selected current disconnect level be less than the current damage level of the MOV material 58.

In the disconnect element 56B, the dual interrupt capabilities disclosed above can be dependent or independent of each other thus providing a thermal interrupt capability and an independent excessive current interrupt capability while preventing the MOV material from overheating and rupturing.

Although not shown in FIGS. 6, 6A or 6B, it is appreciated that the MOV module according to the fourth embodiment of the present may further include end caps or be otherwise encapsulated as described with reference to the other embodiments.

Figure 7A:
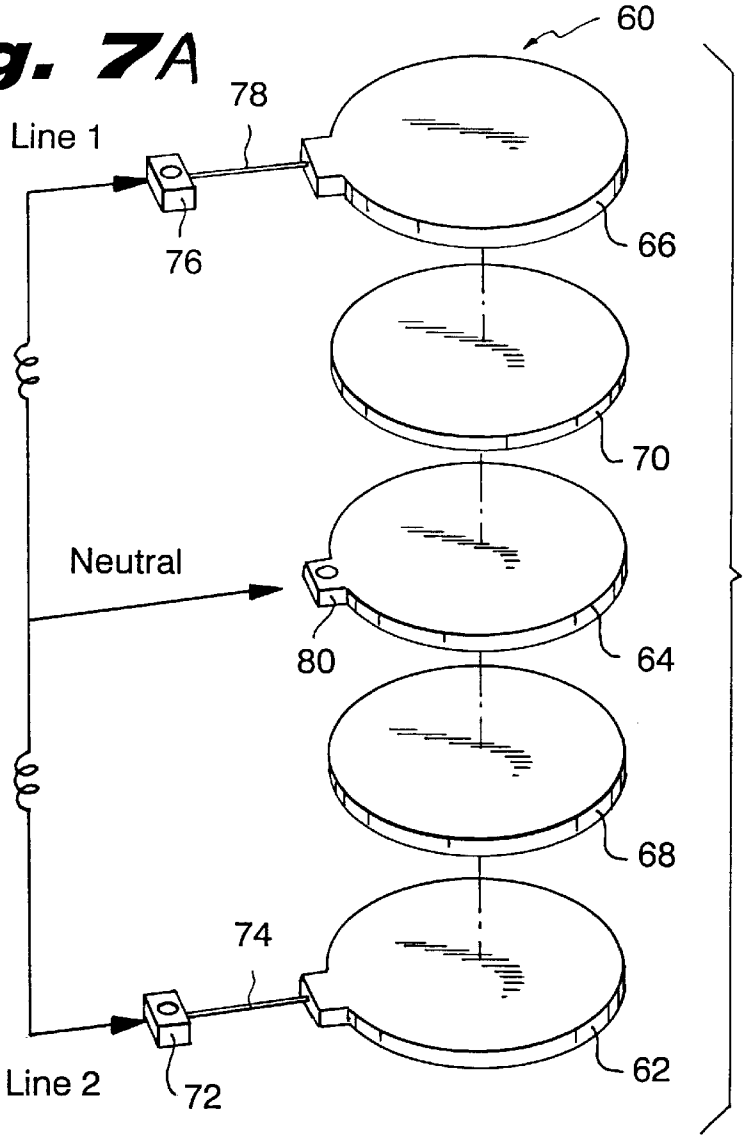
FIG. 7A is an exploded view of a fifth embodiment of the MOV module according to the present invention.
Figure 7C:
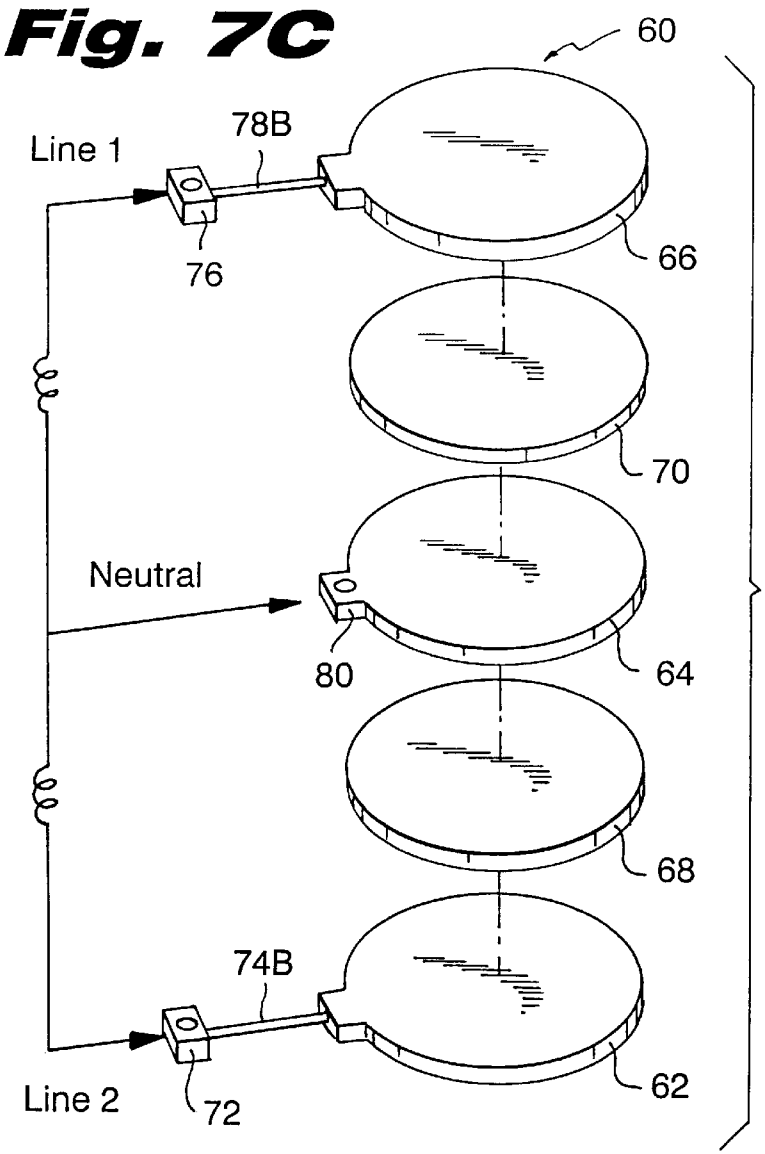
FIG. 7C is an exploded view of a second version of the fifth embodiment of the MOV module according to the present invention.

A fifth embodiments of the MOV module according to the present invention, generally depicted by the numeral 60 is shown in FIG. 7. The MOV module according to the fifth embodiment includes a lower metallic contact plate 62, an intermediate metallic contact plate 64, and an upper metallic contact plate 66. Each of the contact plates have planar upper and lower surfaces and have substantially coextensive peripheral edges.

Interposed between the upper surface of the lower contact plate 62 and the lower surface of the intermediate contact plate 64 is a first layer of MOV material 68. Interposed between the upper surface of the intermediate contact plate 64 and the lower surface of the upper contact plate 66 is a second layer of MOV material 70. The first layer of MOV material 68 provides protection between line 2 and neutral, while the second layer of MOV material 70 provides protection between line 1 and neutral.

Figure 7B:
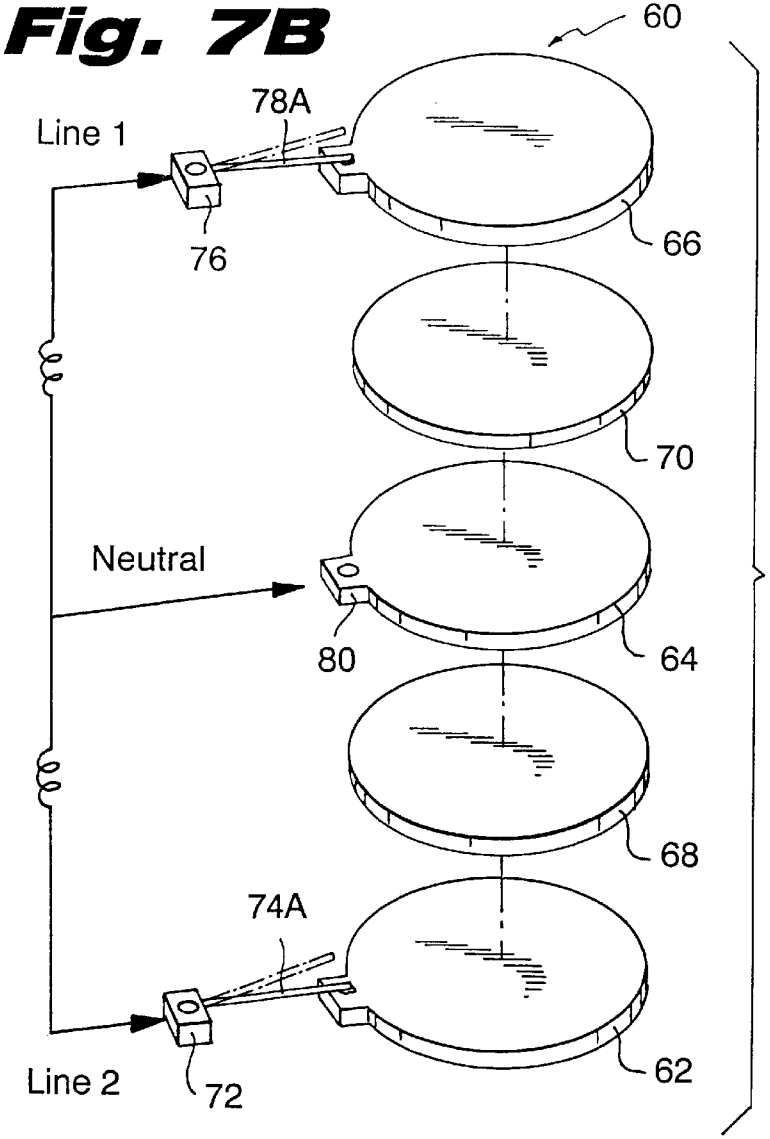
FIG. 7B is an exploded view of a one version of the fifth embodiment of the MOV module according to the present invention.

Disconnect elements 74 and 78 can be each constructed in at least two configurations. FIG. 7A shows the spring finger disconnect approach while FIG. 7B shows the metallic composite material disconnect approach.

In FIG. 7A the disconnect capability is achieved by employing a metal spring finger 74A that at the first end is connected to tab 72 and at the second end is connected to contact plate 62 using a low melting point solder. A further disconnect capability is achieved by employing a metal spring finger 78A that at the first end is connected to tab 76 and at the second end is connected to contact plate 66 using a low melting point solder.

The intermediate contact plate 64 is provided with a contact tab 80 for electrical connection to the neutral phase.

During overvoltage conditions, as shown in FIG. 7A, MOV elements 68 and 70, singly or together, will overheat. This temperature rise will be conveyed to contact plates 62 and 66. Spring finger disconnects 74A and 78A will serve as thermally activated disconnects when the low temperature solder affixing them respectively to contact plates 62 and 66 melt and releases the spring fingers. The operation of the spring fingers will, singly or collectively, remove their associated layer of MOV material from the electrical power source when the disconnect elements 74A and 78A open at a selected temperature that is less than the melting or rupture temperature of the MOV material.

During overcurrent conditions the spring finger disconnect elements 74A and 78A, with specific cross-sectional areas, will operate as excessive current disconnects and will remove their associated layer of MOV material from the electrical power source when the spring finger disconnect elements 74A and 78A open at a selected excessive current that is less than the failure point of MOV materials 68 and 70.

In FIG. 7B the disconnect capability is achieved by employing a metallic composite material 74B that at the first end is connected to tab 72 and at the second end is connected to contact plate 62. A further disconnect capability is achieved by employing a metallic composite material 78B that at the first end is connected to tab 76 and at the second end is connected to contact plate 66.

During overvoltage conditions, MOV elements 68 and 70, as shown in FIG. 7B will overheat causing 74B and 78B to melt, singly or collectively, and disconnect their MOV materials 68 and 70 from the electrical power source. It is essential that the melt temperature of 74B and 78B occur at a selected temperature that is less than the melting or rupture temperature of the MOV materials 68 and 70.

During overcurrent conditions the composite material disconnect elements 74B and 78B, with specific cross-sectional areas, will operate as excessive current disconnects and will remove their associated layer of MOV material 68 and 70 from the electrical power source. It is essential that the composite material disconnect elements 74B and 78B open at a selected excessive current that is less than the failure point of MOV materials 68 and 70.

Connecting a single disconnect element in series with the neutral lead is hazardous and to be avoided. With a single MOV layer failure, for example if MOV 68 were to short circuit, then MOV material 70 would be directly exposed to the potential source between power lines Line 1 and Line 2 that would be twice its normal rating. MOV 70 would also fail as a short circuit and with no fuse available to disconnect the power source from the damaged MOV's the result would be catastrophic damage to the surge protector and possible serious damage to nearby equipment.

It should be appreciated that the MOV module in its various embodiments as described above may be provided with additional contact plates and/or MOV layers to accommodate multiple phase or multiple lead systems without departing from the scope or spirit of the present invention.

The MOV modules according to the present invention as heretofore described may be provided with monitoring devices that indicate the operability of the same. For example, the MOV module may be provided with a LED having an internal or external resistor and diode circuit that will be connected across one or more MOV elements to extinguish when the MOV is disconnected from the power source. The LED or other monitoring indicator, such as audible alarms, relay contact closures can be physically integrated into the protective device to provide a localized troubleshooting aid. The monitoring approaches described above are typical, nonetheless, other suitable monitoring methods may also be used.

As seen from the forgoing an improved MOV module for use with surge arresters that overcomes the disadvantages and shortcoming found in the prior art has been provided.

Specifically, the MOV module according to the present invention will not overheat, rupture or otherwise fail catastrophically when subject to extreme voltage conditions.

Specifically, the MOV module according to the present invention will not overheat, rupture or otherwise fail catastrophically when subject to extreme overcurrent conditions.

Specifically, the MOV module according to the present invention will eliminate the need, expense and misapplication of external overcurrent fusing means and external protective disconnect means of a thermal nature.

Although the present invention has been described in the foregoing, numerous modifications and variations can be made, and will be obvious to those skilled in the art, without departing from the spirit and scope of this invention.

What is claimed is:

1. A module for protecting an electrical device against transient surges from a power source, comprising a module placed in parallel with said power source and said electrical device, said module having a first contact plate for connecting to a power source; a second contact plate for connecting to an electrical device; interposed sequentially between said first and second contact plates, a stationary varistor plate having a selected current and a temperature, an intermediate conductive layer, and an insulating plate; and disconnect means for electrically connecting and disconnecting said first and second contact plates having a temperature and a current proportional to said temperature and current of said varistor and being responsive to temperature or current increases within said disconnect means for electrically disconnecting said first and second contact plates when said temperature of said disconnect means exceeds a predetermined temperature limit being less than the melting temperature of said varistor, and for electrically disconnecting said first and second plates when said current of said disconnect means exceeds an appointed current limit being less than the maximum current tolerated by said varistor.

2. The module according to claim 1, wherein said disconnect means comprises a spring element having a first end electrically connected to said first contact plate and a second end electrically connected to said intermediate conductive layer by a low temperature solder having a melting temperature less than said temperature limit.

3. The module according to claim 2, wherein said spring element is biased to move from a first position in abutment with said intermediate conductive layer to a second position spaced from said intermediate conductive layer when said low temperature solder reaches its said melting temperature.

4. The module according to claim 3, wherein said first contact plate further comprises a tab extending from the body of said plate for connection to an electrical lead.

5. The module according to claim 4, wherein said second contact plate further comprises a tab extending from the body of said plate for connection to an electrical lead.

6. The module according to claim 5, wherein said upper surface of said first contact plate has a recess for receiving said first end of said spring element or the said first contact plate is constructed integrally with said first end of said spring element.

7. The module according to claim 5, wherein at least one of said insulating plate and said first conducting plate has a central through hole through which passes said disconnect means.

8. The module according to claim 7, further comprising a pair of end caps for encapsulating said module.

9. The module according to claim 2, wherein said spring element comprises a material having a specified cross-sectional area which melts when a current passing through said material exceeds said current limit.

10. The module according to claim 9, wherein said first contact plate further comprises a tab extending from the body of said plate for connection to an electrical lead.

11. The module according to claim 10, wherein said second contact plate further comprises a tab extending from the body of said plate for connection to an electrical lead.

12. The module according to claim 11, wherein said upper surface of said first contact plate has a recess for receiving said first end of said spring element or the said first contact plate is constructed integrally with said first end of said spring element.

13. The module according to claim 12, wherein at least one of said insulating plate and said first contact plate has a central through hole through which passes said disconnect means.

14. The module according to claim 13, further comprising a pair of end caps for encapsulating said module.

15. The module according to claim 1, wherein said disconnect means comprises a flexible laminate sheet having one layer formed of a non-conductive resilient material and a second layer formed of a conductive metal, said flexible laminate sheet being fixedly secured by its opposite ends in electrical connection with said first contact plate, said flexible sheet having a central portion distended so that said layer of conductive metal is in electric contact with and secured to said intermediate conductive layer by a low temperature solder having a melting temperature less than said temperature limit.

16. The module according to claim 15, wherein said first contact plate further comprises a tab extending from the body of said plate for connection to an electrical lead.

17. The module according to claim 16, wherein said second contact plate further comprises a tab extending from the body of said plate for connection to an electrical lead.

18. The module according to claim 17, wherein said layer of insulating material has a central through hole.

19. The module according to claim 18, further comprising a pair of end caps for encapsulating said module.

20. A module according to claim 15, wherein said plastic sheet is biased to be positioned remote from said intermediate conductive layer.

21. The module according to claim 1, wherein said disconnect means comprises a flexible laminate sheet having one layer formed of a non-conductive resilient material and a second layer formed of a conductive metal, said flexible laminate sheet being fixedly secured by its opposite ends in electrical connection with said first contact plate, said flexible sheet having a central portion distended so that said layer of conductive metal is in electric contact with and secured to said intermediate conductive layer by a solder or pressure, with the conductive metal melting at a specific current that is less than the current limit.

22. The module according to claim 21, wherein said first contact plate further comprises a tab extending from the body of said plate for connection to an electrical lead.

23. The module according to claim 22, wherein said second contact plate further comprises a tab extending from the body of said plate for connection to an electrical lead.

24. The module according to claim 23, wherein said layer or insulating material has a central through hole.

25. The module according to claim 24, further comprising a pair of end caps for encapsulating said module.

26. The module according to claim 1, wherein said disconnect means comprises a sheet of metallic foil being fixedly secured at its perimeter in electrical connection with said first contact plate, said foil sheet having a central portion distended so that said layer of metallic foil is in contact with said intermediate conductive layer, said metallic foil having a melting temperature less than said temperature limit.

27. The module according to claim 26, wherein said first contact plate further comprises a tab extending from the body of said plate for connection to an electrical lead.

28. The module according to claim 27, wherein said second contact plate further comprises a tab extending from the body of said plate for connection to an electrical lead.

29. The module according to claim 28, wherein said layer or insulating material has a central through hole.

30. The module according to claim 29, further comprising a pair of end caps for encapsulating said module.

31. The module according to claim 1, wherein said disconnect means comprises a sheet of metallic foil of specific geometry and thickness, being fixedly secured at its perimeter in electrical connection with said first contact plate said foil sheet having a central portion distended so that said sheet of metallic foil is in contact with said intermediate conductive layer, said metallic foil melting open when exposed to a specific current less than said current limit.

32. The module according to claim 31, wherein said first contact plate further comprises a tab extending from the body of said plate for connection to an electrical lead.

33. The module according to claim 32, wherein said second contact plate further comprises a tab extending from the body of said plate for connection to an electrical lead.

34. The module according to claim 33, wherein said layer or insulating material has a central through hole.

35. The module according to claim 34, further comprising a pair of end caps for encapsulating said module.

36. The module according to claim 1, wherein said plates and said intermediate conductive layer are disc shaped, have equal diameters and are stacked on each other.

* * * * *